US011460271B2

(12) United States Patent
Seigler

(10) Patent No.: US 11,460,271 B2
(45) Date of Patent: Oct. 4, 2022

(54) DRY FIRE PRACTICE TRAINING DEVICE

(71) Applicant: Stanley Hahn Seigler, Kamiah, ID (US)

(72) Inventor: Stanley Hahn Seigler, Kamiah, ID (US)

( * ) Notice: Subject to any disclaimer, the term of this patent is extended or adjusted under 35 U.S.C. 154(b) by 148 days.

(21) Appl. No.: 16/425,832

(22) Filed: May 29, 2019

(65) Prior Publication Data

US 2020/0378724 A1 Dec. 3, 2020

(51) Int. Cl.
*F41G 3/26* (2006.01)

(52) U.S. Cl.
CPC ..... *F41G 3/2616* (2013.01)

(58) Field of Classification Search
CPC ..... F41G 3/2616
USPC ..... 434/21
See application file for complete search history.

(56) References Cited

U.S. PATENT DOCUMENTS

| | | | | |
|---|---|---|---|---|
| 4,725,235 | A | 2/1988 | Schroeder | |
| 5,577,962 | A | 11/1996 | Kounoe | |
| 8,770,978 | B2 | 7/2014 | Botten | |
| 8,777,620 | B1 | 7/2014 | Baxter | |
| 9,163,904 | B2 | 10/2015 | Ohr | |
| 9,182,189 | B2 | 11/2015 | Seigler | |
| 2011/0047847 | A1* | 3/2011 | Hughes | F41A 19/16 42/1.01 |
| 2011/0306020 | A1* | 12/2011 | Peterson | F41A 33/06 434/18 |
| 2013/0108991 | A1 | 5/2013 | Walls | |
| 2014/0193778 | A1* | 7/2014 | Seigler | F41A 33/00 434/16 |
| 2017/0146310 | A1 | 5/2017 | Biran | |
| 2017/0268845 | A1 | 9/2017 | Jakob | |
| 2019/0025000 | A1 | 1/2019 | Bascom | |

FOREIGN PATENT DOCUMENTS

| | | |
|---|---|---|
| KR | 20070010263 | 1/2007 |
| WO | 2008069560 | 6/2008 |

OTHER PUBLICATIONS

International Search Report and Written Opinion dated Feb. 3, 2020 in International Patent Application No. PCT/US2019/058266 filed: Oct. 28, 2019.

* cited by examiner

*Primary Examiner* — Robert P Bullington, Esq.

(57) ABSTRACT

Various embodiments of the present technology may provide a dry fire training device for use with a pistol having a magazine compartment and a trigger mechanism. The dry fire training device includes a magazine including a lever providing a means for interaction between the trigger mechanism and a detent reed. The lever may be configured to move between a resting position and a firing position. The magazine may also include a compression spring configured to bias the lever to the resting position. The magazine may further include a swing lock component configured to move the lever to the firing position behind the trigger mechanism when the magazine is inserted into the magazine compartment.

9 Claims, 4 Drawing Sheets

DRY FIRE PRACTICE TRAINING DEVICE

CROSS-REFERENCE TO RELATED APPLICATIONS

NOT APPLICABLE

STATEMENT REGARDING FEDERALLY SPONSORED RESEARCH OR DEVELOPMENT

NOT APPLICABLE

REFERENCE TO A SEQUENCE LISTING, A TABLE, OR A COMPUTER PROGRAM, LISTING COMPACT DISC APPENDIX

NOT APPLICABLE

BACKGROUND OF THE INVENTION

Live firing is the best way to practice drawing and firing a weapon. The practice process builds muscle memory, and helps the shooter develop proper techniques of delivery and complete weapon control. There are several negatives of this type of practice. Using ammunition is an ongoing expense, and measures have to be taken to practice with safety. This could mean traveling to a firing range, providing safety equipment for the shooter and possibly others, and allotting special time in the schedule for the practice session.

Dry fire practice is a good substitute for live fire practice. Dry firing is another process of building muscle memory whereby a firearm, especially a pistol, is drawn, aimed, and fired without using live ammunition. This enables the practice of firing a weapon to proceed smoothly and accurately without all of the negatives of live fire practice. Because no live ammunition is used, there is no ongoing expense, there is no need to use safety equipment, a special shooting environment is not necessary, and practicing can be accomplished in much less time.

Dry firing also allows the shooter to practice in the actual environment where the weapon may need to be used for protection such as in the home. With complete safety, actual shooting scenarios can be practiced in and around the home.

Practicing at the range can also be improved. When live fire is practiced at the range, the novice shooter usually has to spend a significant amount of time and expend a lot of ammunition getting accustomed to the report and recoil of the pistol. Before live practice begins, some dry fire practicing can be done. This gets the novice shooter accustomed to the trigger feel before having to deal with the recoil and the report of live firing.

A major negative factor occurs with most methods of dry firing because when a semi-automatic pistol is live fired, it resets its firing pin and is ready to be fired again until the magazine is empty. The shooter's hands remain in the firing position, and just the trigger finger and the trigger are employed. With normal dry fire practice, after the first activation of the trigger releasing the firing pin, the shooter must remove a hand from the pistol and ratchet the slide back in order to reset the firing pin. The shooter can then let the trigger return the to its unfired position. The pistol is then ready for another activation. This must be done each time a shot is simulated. Doing this, teaches improper muscle memory because it is not at all what happens during actual live fire. When people are in real shooting situations, they need to be able to depend on simply acting upon how they have practiced. Anything else could be deadly.

Another negative for standard dry fire practice is that there is concern as to wear and tear on the constant releasing of a weapon's firing pin without it having the cushioning effect of the firing pin striking a round of ammunition.

Some patented training systems incorporate computer graphics into the training scenario. Other patents address the duplication of a pistol's recoil, laser marking of "shots", projecting images onto a screen, etc.

Here are a few examples of pistol training patents:

U.S. PATENT DOCUMENTS

U.S. Pat. No. 5,993,215; Nov. 30, 1999 Jansen; Kotsiopoulos

U.S. Pat. No. 4,657,511 Apr. 14, 1987 Allard; Briard; Saunier

U.S. Pat. No. 4,725,235 Feb. 16, 1988 Schroeder; Osborne

U.S. Pat. No. 4,737,106 Apr. 12, 1988 Laciny

U.S. Pat. No. 4,804,325 Feb. 14, 1989 Willits; Kleeman; Willits

U.S. Pat. No. 5,451,162 Sep. 19, 1995 Parsons

U.S. Pat. No. 9,182,189 Nov. 10, 2015 Seigler

These are some devices or systems that aid in dry fire practice, but only one of the patented devices (U.S. Pat. No. 9,182,189) or systems address the "hands-free" trigger reset problem or the firing pin use problem.

Negative qualities of these devices or systems are that they are either user intensive and/or expensive to purchase, but most significantly they do not allow a shooter to use a fully functioning pistol that he may already own. There is also a learning curve or training necessary to use these systems, but most of all, none of the patented devices or systems except (U.S. Pat. No. 9,182,189) address the "hands-free" trigger reset problem and the possible firing pin damage problem of normal dry fire practice.

The device with U.S. Pat. No. 9,182,189 (my previous patent) solves all of the stated problems, but there are improvements that need to be made. The means for insertion into the magazine's well has been simplified, internal parts have been improved, and alterations have been provided so that the device can interact with electronic training systems through a micro switch and electronic components.

There is no device that provides proper dryfire training as already described that also has components that will allow it to interact with electronic training devices like lasers.

There is therefore a need for a dry fire training device that uses a fully functioning pistol, allows for precise muscle memory training, is simple to operate, prevents the firing pin of the fully functioning pistol from being damaged, provides for safe on-site home training, inserts easily into the magazine well, and has capabilities to interact with electronic training systems. This new device improves upon existing device U.S. Pat. No. 9,182,189 (my previous patent).

BRIEF SUMMARY OF THE INVENTION

The invention that is to be described accomplishes the most important aspects of dry fire training: no live ammunition is used providing safety and no on going expense, convenience of practicing in the home environment where the protective, fully functioning pistol would most likely be used for defensive purposes, no involved disassembling and reassembling of any of the fully functional pistol's components, the realistic feel of the trigger during the firing process and the trigger reset, precise muscle memory training using only the trigger finger motion, and does not negatively affect the fully functional pistol's firing pin. This invention also helps the novice shooter train with his pistol before he has to deal with the recoil and the report of firing live ammunition. This invention is simple to use, provides realistic feel of the trigger operation, produces a sound that simulates the release of the pistol's firing pin, and does not require any alterations to the fully functional pistol such as disassembling and reassembling of any parts of the pistol. There is therefore a need for a dry fire training device that uses a fully functioning pistol, allows for precise muscle memory training, is simple to operate, prevents the firing pin of the fully functioning pistol from being damaged, provides for safe on-site home training, inserts easily into the magazine well, and has capabilities to interact with electronic training systems. This new device improves upon existing device U.S. Pat. No. 9,182,189 (my previous patent). This improved device addresses these situations through the pistol's magazine compartment. This invention simply slides into the magazine compartment in the pistol's handle, and practice can begin. It requires no alterations to the pistol before or after practice. This new device functions completely independent of the pistol's firing pin.

An additional point of safety is that the base plate, which is always visible to the shooter and trainer, is a bright orange color to identify the safety of device from a magazine that could contain live ammunition. There is no way that this device can mechanically accommodate any live ammunition.

DETAILED DESCRIPTION OF THE INVENTION

Figure 1:
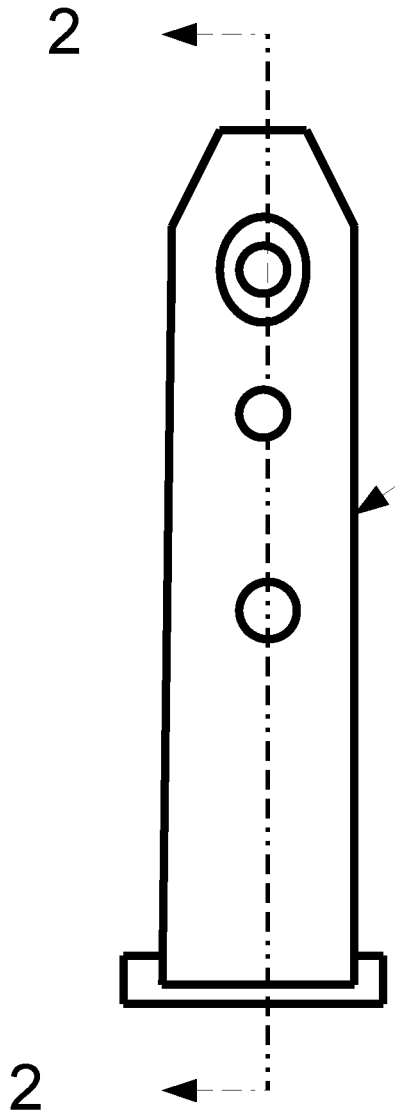
FIG. 1 illustrates a back view of a simulated magazine case with an adjusting set screw base adhered to its back wall.
Figure 2:
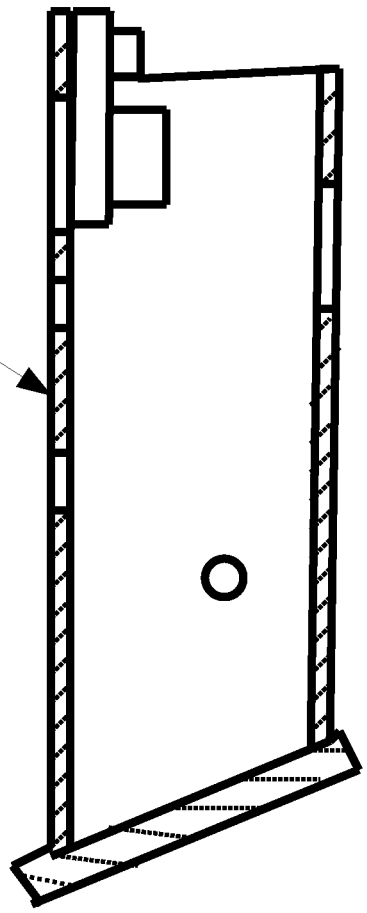
FIG. 2 illustrates a sectional side view of said simulated magazine case showing the set screw base adhered to its back wall.

FIGS. 1 & 2 illustrate the simulated magazine case 1 that has six holes: a pair of holes in each side to receive the fulcrum pin 7 for the lever 2 to hinge upon; a third hole in the front of said magazine 1 to provide access to the regulating set screw 10 which is mounted in the set base 5 as illustrated in FIG. 2, being adhered to the inside back wall of said magazine case 1; a forth hole beneath the previously mentioned hole which allows for adjusting the mounting screw for the detent reed 6; a fifth hole in the back of the magazine 1 for adjusting a second set screw 10 in the micro switch lever 4 to regulate the adjusting point of another training device; a sixth hole in the front of the magazine 1 to allow the swing lock 3 to interact with a member in the pistol's magazine well to lift and place the lever 2 in the proper position with the pistol's trigger mechanism when the device is inserted into the pistol's magazine well.

Figure 3:
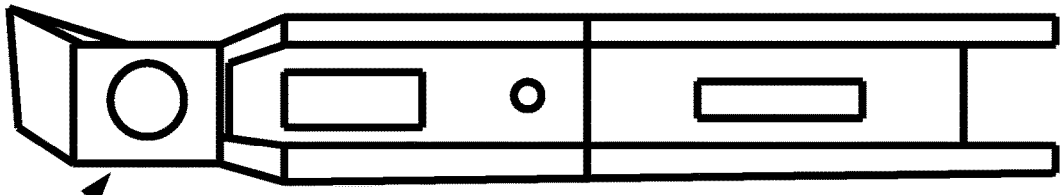
FIG. 3 illustrates a top view of a lever.
Figure 4:
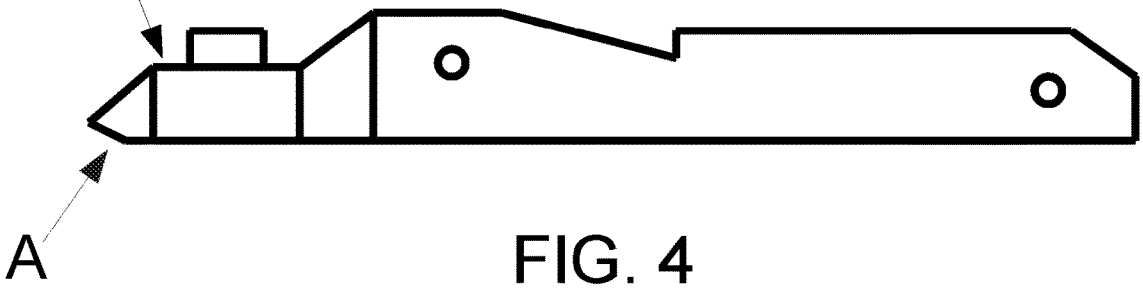
FIG. 4 illustrates a side view of said lever
Figure 19:
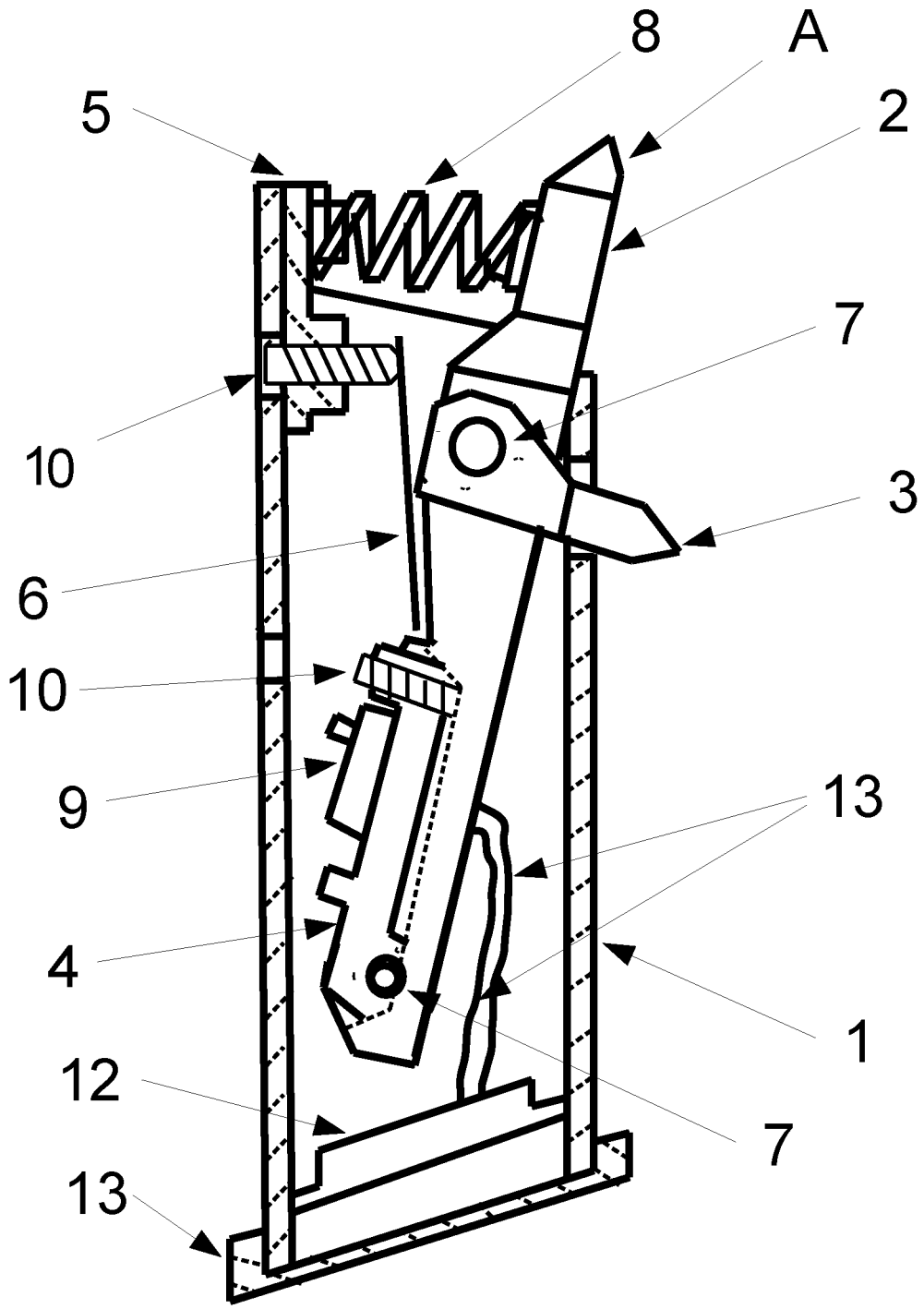
FIG. 19. illustrates a sectional view of the assembled device in its resting position.

FIGS. 3 & 4 illustrate the lever 2 with various shapes that allow it to support the detente reed 6, locate the coil spring 7, mount the swing lock 3, and mount the micro switch lever 4, and a projection at the top to interact with the pistol's trigger mechanism at point A; all these are illustrated in FIG. 19.

Figure 5:
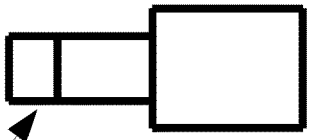
FIG. 5 illustrates a top view of a swing lock.
Figure 6:
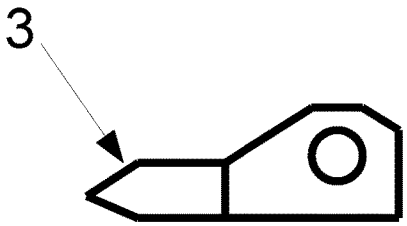
FIG. 6 illustrates a side view of said swing lock.

FIGS. 5 & 6 illustrate the swing lock 3 which is pin mounted to the lever 2 and protrudes out of the hole in the front of the magazine's 1 front side to interact with a member in the pistol's magazine well which places the lever 2 into its proper position with the pistol's trigger mechanism.

Figure 7:
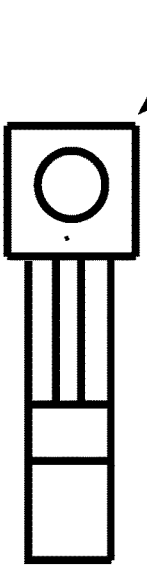
FIG. 7 illustrates a top view of a micro switch lever.
Figure 8:
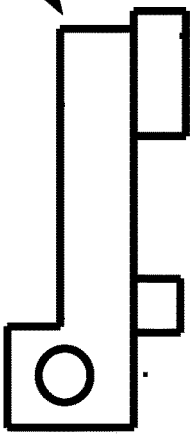
FIG. 8 illustrates a side view of said micro switch lever.

FIGS. 7 & 8 illustrate a lever 4 which pin mounts to the lever 2, has a hole for accommodating the set screw 10 for adjustments, and provides a location for mounting a micro switch 9.

Figure 9:
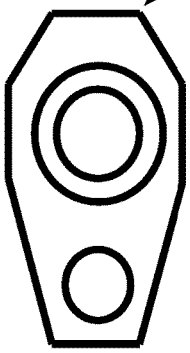
FIG. 9 illustrates a top view of a set screw base.
Figure 10:
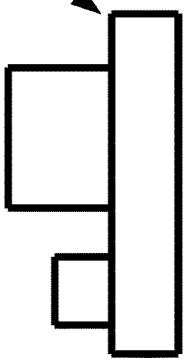
FIG. 10 illustrates a side view of said set screw base.

FIGS. 9 & 10 illustrate the set screw base 5 which is adhered to the inner front wall of the magazine 1 and accommodates the set screw 10 to adjust when the detente reed 6 snaps as the lever 2 is actuated by the pistol's trigger mechanism at point A.

Figure 11:
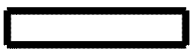
FIG. 11 illustrates a side view of a fulcrum pin.

FIG. 11 illustrates a fulcrum pin 6 that allows the lever 5 to rotate to activated the detent reed 6 by the action transferred through the lever 5 at point A, moving the detent reed 6 against the set screw 10, producing the simulated tactile release and the audible response of the weapon's firing pin. Another fulcrum pin 7 mounts the micro switch lever 4 onto the lever 2.

Figure 12:
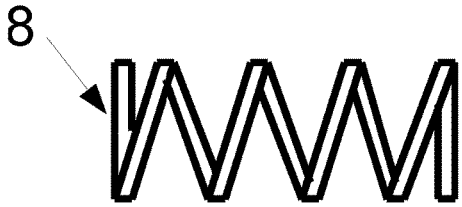
FIG. 12 illustrates a side view of a compression spring.

FIG. 12 illustrates a compression spring 8 that returns the lever 2 to its resting position against the front of the magazine 1 and resets the pistol's trigger mechanism to its resting position.

Figure 13:
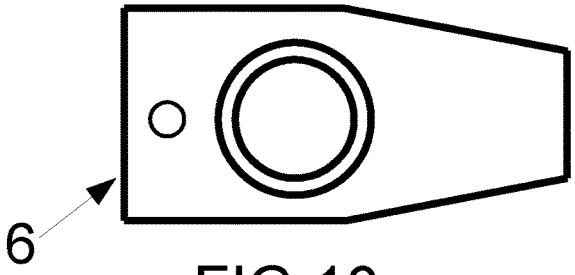
FIG. 13 illustrates a top view of a detente reed.

FIG. 13 illustrates a detent reed 6 which is mounted to the lever 2 and provides the tactile release simulating the feel of the release of the pistol's firing pin and an audible response simulating the sound of the release of the pistol's firing pin.

Figure 14:
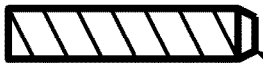
FIG. 14 illustrates a side view of a set screw.

FIG. 14 illustrates the set screw 10 which is used in the set screw base 5 and the micro switch lever 4 and provides for adjustments of both as illustrated in FIG. 19.

Figure 15:
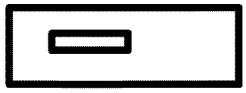
FIG. 15 illustrates a top view of a micro switch.
Figure 16:
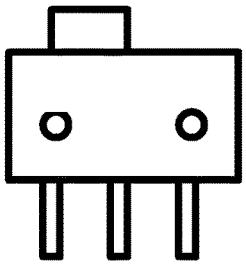
FIG. 16 illustrates a side view of said micro switch.

FIGS. 15 & 16 illustrate the micro switch 9 which is mounted to its lever 4 and presses against the inner wall of the magazine 1 to activate an electronic component for other training devices.

Figure 17:
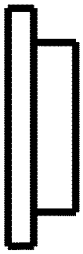
FIG. 17 illustrates a side view of a micro processor.
Figure 18:
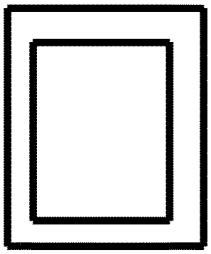
FIG. 18 illustrates a top view of said micro processor.

FIGS. 17 & 18 illustrate the micro processor 11 that is activated by the micro switch 9 when the lever assembly is hinged towards the back of the magazine 1 and thus provides an electrical signal received by another device for dry fire training.

FIG. 19 illustrates a sectional view of the assembled dry fire training device showing the lever 2 in its resting position. The compression spring 8 is applying a forward force to hold the lever 2 forward. This view shows the detent reed 6 resting against the set screw 10 in its "untripped" or unreleased position. The set screw 10 provides adjustment to control the release of the detent reed 6 at precisely the right position in the travel of the pistol's trigger. The swing lock 3 is mounted to the lever 2 so that when the device is inserted into the pistol's magazine compartment, the swing lock 3 interacts with the pistol's magazine release bar and pushes the lever 2 towards the back of pistol far enough that the lever 2 can freely move behind the pistol's trigger mechanism. The swing lock 3 then swings out of the way so that the lever 2 assembly is free to interact with the pistol's trigger mechanism. When the pistol's trigger mechanism pressed against the lever 2 at point A, the lever 2 assembly swings towards the back of the magazine 1. This movement compresses the coil spring 8, bends the detent reed 6 through its activation point against the set screw 10 and provides the tactile and the audible response, thus simulating the release of the pistol's firing pin; the micro switch 9 is compressed against the wall of the magazine 1 completing the circuit to the micro processor which sends a signal to interact with a separate dry fire training device. When the pistol's trigger is released, the coil spring 8 returns the lever 2 assembly to its resting position.

The previously patented device U.S. Pat. No. 9,182,189 had a sliding member that had to be pushed up to accomplish the positioning of the lever 2 behind the trigger mechanism. Then, after the lever 2 was in its working position, the shooter needed to pull the sliding lever lifter back to its resting position. This new design accomplishes this setting action without any additional actions of the shooter. The new devise also has means of interacting electronically with other dry fire training devices.

I claim:

1. A dry fire training device for use with a pistol having a magazine compartment and a trigger mechanism, wherein the dry fire training device comprises: a magazine comprising: a lever providing a means for interaction between the trigger mechanism and a detent reed and configured to move between a resting position and a firing position; a compression spring configured to bias the lever to the resting position; and a swing lock component configured to move the lever to the firing position behind the trigger mechanism when the magazine is inserted into the magazine compartment.

2. The dry fire training device of claim 1, wherein the magazine compartment is utilized to provide a means for resetting the trigger mechanism after the pistol is dry fired.

3. The dry fire training device of claim 1, wherein the magazine has six holes: a hole on each of two opposite sides to receive a fulcrum pin for the lever to hinge upon; a third hole in the back of said magazine to provide access to a regulating set screw which is mounted in a set screw base, being adhered to an inside back wall of said magazine; a fourth hole beneath the third hole which allows for adjusting a mounting screw for the detent reed; a fifth hole in the back of the magazine for adjusting a second set screw in a micro switch lever to activate a laser of the dry fire training device; a sixth hole at a front of the magazine to allow the swing lock to interact with a member in the magazine compartment to lift and place the lever in the firing position when the magazine of the dry fire training device is inserted into the magazine compartment.

4. The dry fire training device of claim 3, wherein the magazine comprises a regulating assembly which is adhered to said magazine's inside front surface comprised of the set screw base molded with a hole to receive the set screw which allows the detent reed to be adjusted to activate at the position when the trigger mechanism would release a firing pin of the pistol during normal live fire.

5. The dry fire training device of claim 1, wherein the lever is configured to support the detent reed, a locator for the compression spring, the swing lock, and various mounting surfaces for attaching a micro switch bearing lever.

6. The dry fire training device of claim 5, wherein the lever further comprises a surface to support the detent reed which provides audible and tactile simulation of the release and reset of a firing pin of the pistol for repetitive trigger action; a hole for a machine screw to retain said detent reed; a projection and platform for the compression spring which returns the lever to its resting position after the trigger is released thereby resetting the trigger mechanism after the pistol is dry fired; two holes for a fulcrum pin for said lever which also provides for the mounting of a micro switch lever to rotate upon; two more holes for mounting said swing lock; and an elongated end that intercepts the trigger mechanism.

7. The dry fire training device of claim 5, further comprising a micro switch and a mounting assembly, wherein the mounted micro switch completes a circuit to a microprocessor to activate the the dry fire training device.

8. The dry fire training device of claim 6, wherein the swing lock component interacts with a magazine release bar disposed in the magazine compartment when the dry fire training device is inserted into the pistol, and wherein the magazine release bar positions the lever behind the trigger mechanism.

9. The dry fire training device of claim 1, further comprising a base plate coupled to the magazine, wherein the base plate indicates whether the pistol is safe for dry fire practice training.

* * * * *